US010041458B2

(12) United States Patent
Batchelor et al.

(10) Patent No.: US 10,041,458 B2
(45) Date of Patent: Aug. 7, 2018

(54) INJECTOR CLAMP

(71) Applicant: Perkins Engines Company Limited, Peterborough (GB)

(72) Inventors: James Kenneth Batchelor, Peterborough (GB); Joe Daniel Bradley, Northampton (GB); Richard Kitchen, Peterborough (GB); James Andrew Darley, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 42 days.

(21) Appl. No.: 15/392,299

(22) Filed: Dec. 28, 2016

(65) Prior Publication Data

US 2017/0204825 A1 Jul. 20, 2017

(30) Foreign Application Priority Data

Jan. 19, 2016 (GB) ..... 1600984.7

(51) Int. Cl.
*F02M 61/14* (2006.01)

(52) U.S. Cl.
CPC ..... *F02M 61/14* (2013.01); *F02M 2200/855* (2013.01)

(58) Field of Classification Search
CPC ..... F02M 61/14; F02M 2200/855
See application file for complete search history.

(56) References Cited

U.S. PATENT DOCUMENTS

| | | | | |
|---|---|---|---|---|
| 3,528,613 | A * | 9/1970 | Berlyn | F02M 61/08 123/470 |
| 4,901,700 | A * | 2/1990 | Knight | F02M 61/14 123/470 |
| 5,806,494 | A | 9/1998 | Glassey | |
| 5,878,719 | A | 3/1999 | Nakagomi | |
| 6,178,950 | B1 | 1/2001 | Stockner et al. | |

(Continued)

FOREIGN PATENT DOCUMENTS

| | | | |
|---|---|---|---|
| CN | 202483775 | U | 10/2012 |
| EP | 0751290 | A1 | 1/1997 |

(Continued)

OTHER PUBLICATIONS

United Kingdom Intellectual Property Office, Search Report in United Kingdom Patent Application No. GB1600984.7, dated Jul. 18, 2016, 1 p.

*Primary Examiner* — Joseph Dallo
(74) *Attorney, Agent, or Firm* — Leydig, Voit & Mayer, Ltd.

(57) ABSTRACT

An injector clamp for clamping at least two injectors to an engine head includes a body having at least a first arm and a second arm. Each arm having a first clamping surface and a second clamping surface on opposing sides of the body. A distance between the first clamping surfaces of the first arm and the second arm is different from a distance between the second clamping surfaces of the first arm and the second arm. The body is configurable, for use, in one of: a first position in which the first clamping surfaces from each of the first and second arms can abut with an injector; and a second position in which the second clamping surfaces from each of the first and second arms can abut with an injector.

20 Claims, 11 Drawing Sheets

(56) References Cited

U.S. PATENT DOCUMENTS

| | | | | |
|---|---|---|---|---|
| 6,196,194 | B1 * | 3/2001 | Mitchell | F02M 61/14 123/470 |
| 6,269,796 | B1 * | 8/2001 | Mitchell | F02M 57/025 123/468 |
| 6,286,768 | B1 * | 9/2001 | Vetters | F02M 57/021 239/533.2 |
| 6,431,152 | B1 * | 8/2002 | Estacio | F02M 61/14 123/470 |
| 6,745,752 | B1 * | 6/2004 | Jensen | B25B 27/0028 123/470 |
| 7,334,572 | B1 * | 2/2008 | Diggs | F02F 7/006 123/195 C |
| 8,047,183 | B2 | 11/2011 | Aronhalt et al. | |
| 8,701,632 | B2 * | 4/2014 | Solferino | F02M 61/14 123/470 |
| 2004/0040543 | A1 * | 3/2004 | Mickelson | F02M 61/14 123/470 |
| 2004/0069280 | A1 * | 4/2004 | Evancik | F02M 61/14 123/470 |
| 2004/0118383 | A1 * | 6/2004 | Gould | F02M 61/14 123/470 |
| 2004/0159311 | A1 * | 8/2004 | Anello | F02M 61/14 123/470 |
| 2011/0073076 | A1 * | 3/2011 | Lazich | F02M 61/14 123/470 |
| 2012/0060797 | A1 * | 3/2012 | Engquist | B22F 3/1017 123/470 |
| 2013/0174810 | A1 * | 7/2013 | Levey | F02M 61/14 123/470 |
| 2016/0025056 | A1 * | 1/2016 | Smaldone | F02M 61/14 123/470 |

FOREIGN PATENT DOCUMENTS

| | | | |
|---|---|---|---|
| EP | 1493916 | A1 | 1/2005 |
| EP | 1482169 | B1 | 3/2008 |
| EP | 2053235 | A2 | 4/2009 |
| EP | 1001161 | A2 | 5/2016 |
| WO | WO 84/02161 | A1 | 6/1984 |

* cited by examiner

INJECTOR CLAMP

CROSS-REFERENCE TO RELATED APPLICATIONS

This application claims priority to United Kingdom Patent Application No. GB1600984.7, filed Jan. 19, 2016, which is incorporated by reference herein in its entirety for all purposes.

TECHNICAL FIELD

The present disclosure relates to an injector clamp. More particularly, the present disclosure relates to an injector clamp that can be used to mount injectors onto engine heads of different configurations.

BACKGROUND

Manufacturers of engine components have been known to typically produce clamps that can be used for mounting one or more injectors onto an engine head. For example, U.S. Pat. No. 7,334,572 (hereinafter referred to as "the '572 patent") discloses a system for securing a fuel injector in an internal combustion engine. The system includes a clamp for securing adjacent injectors to a cylinder head. The clamp includes a central portion with a hole for receiving a fastener to secure the clamp to the cylinder head, and a pair of symmetrical crescent-shaped clamping forks forming a U-shaped opening to facilitate lateral sliding engagement with diametrically opposed flatted portions of corresponding fuel injectors. Each arm includes an arcuate pad that engages a corresponding shoulder of the fuel injector to provide an axial clamping force to the fuel injector. The distance between the distal ends of one fork and the semicircular portion of the opposite fork can be selected to allow lateral sliding disengagement of the clamp from one of the adjacent injectors without rotation or removal of the other injector to facilitate servicing of individual injectors.

However, when multiple configurations of engine heads are produced, specifications pertaining to one configuration of engine head may differ from another configuration of engine head. For example, a cylinder spacing, used to define distance between adjacent cylinders, in one type of engine head may be different from a cylinder spacing in another type of engine head. Accordingly, a position of the fuel injectors may also vary to correspond with the cylinder spacing present on such multiple configurations of engine heads. In such cases, previously known systems such as, but not limited to, the system of '572 patent cannot be used to accomplish a mounting of the fuel injectors across different configurations of engine heads. As a result, manufacturers of previously known clamping systems may be required to produce unique clamps for mounting injectors on engine heads with different configurations, and may thus incur increased manufacturing costs.

Therefore, with multiple configurations of engine heads being produced by engine component manufacturers, there exists a need for a single system that can be used to accomplish mounting of the injectors on at least two different configurations of engine heads.

SUMMARY OF THE DISCLOSURE

In an aspect of the present disclosure, an injector clamp for clamping at least two injectors to an engine head includes a body having at least a first arm and a second arm. Each arm having a first clamping surface and a second clamping surface on opposing sides of the body. A distance between the first clamping surfaces of the first arm and the second arm is different from a distance between the second clamping surfaces of the first arm and the second arm. The body is configurable, for use, in one of: a first position in which the first clamping surfaces from each of the first and second arms can abut with an injector; and a second position in which the second clamping surfaces from each of the first and second arms can abut with an injector.

In another aspect of the present disclosure, an injector clamp for clamping at least two injectors to an engine head includes a body having at least a first arm and a second arm. Each arm has a first clamping surface and a second clamping surface on opposing sides of the body. The body further defines a first bolting area disposed between the second clamping surfaces of the first arm and the second arm; and a second bolting area disposed between the first clamping surfaces of the first arm and the second arm. A height of the body measured between the first bolting area and the pair of second clamping surfaces is different from a height of the body measured between the second bolting area and the pair of first clamping surfaces.

In yet another aspect of the present disclosure, a reversible injector clamp assembly for mounting at least a pair of injectors on one of two different configurations of engine heads is provided. The reversible injector clamp assembly includes a body extending along a longitudinal axis and having a pair of arms. Each arm carries a pair of appendages that are laterally spaced apart in relation to one another. Each appendage includes an upper portion and a lower portion respectively. The body defines a first clamping surface in the lower portion of each appendage. The first clamping surfaces from the pair of arms are spaced apart from one another at a first distance. The body further defines a second clamping surface defined in the upper portion of each appendage. The second clamping surfaces from the pair of arms are spaced apart from one another at a second distance that is lesser than the first distance.

Other features and aspects of this disclosure will be apparent from the following description and the accompanying drawings.

DETAILED DESCRIPTION

Wherever possible, the same reference numbers will be used throughout the drawings to refer to same or like parts. Moreover, references to various elements described herein are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
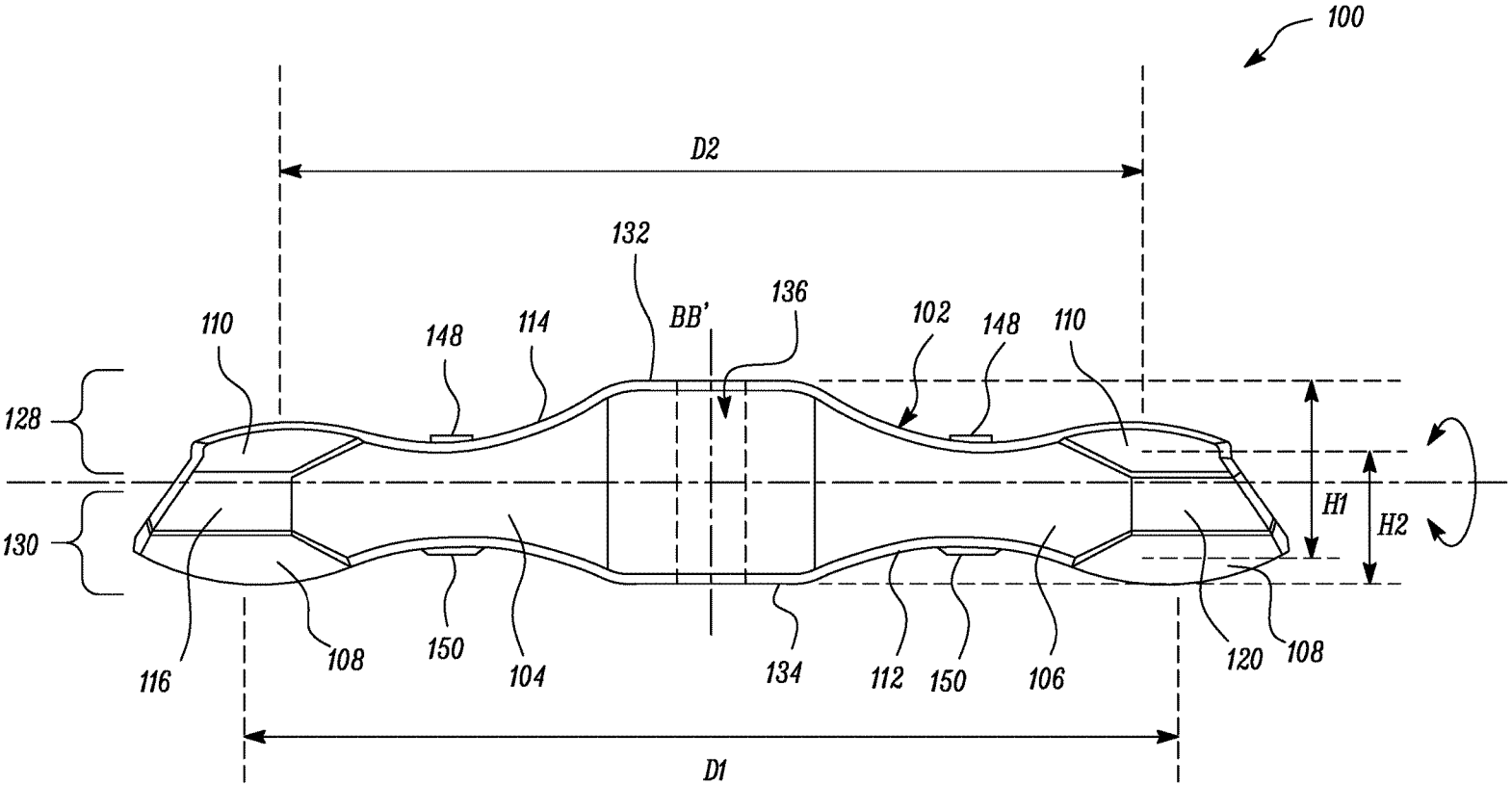
FIG. 1 is a front view of a body of an injector clamp assembly, in accordance with an embodiment of the present disclosure.
Figure 2:
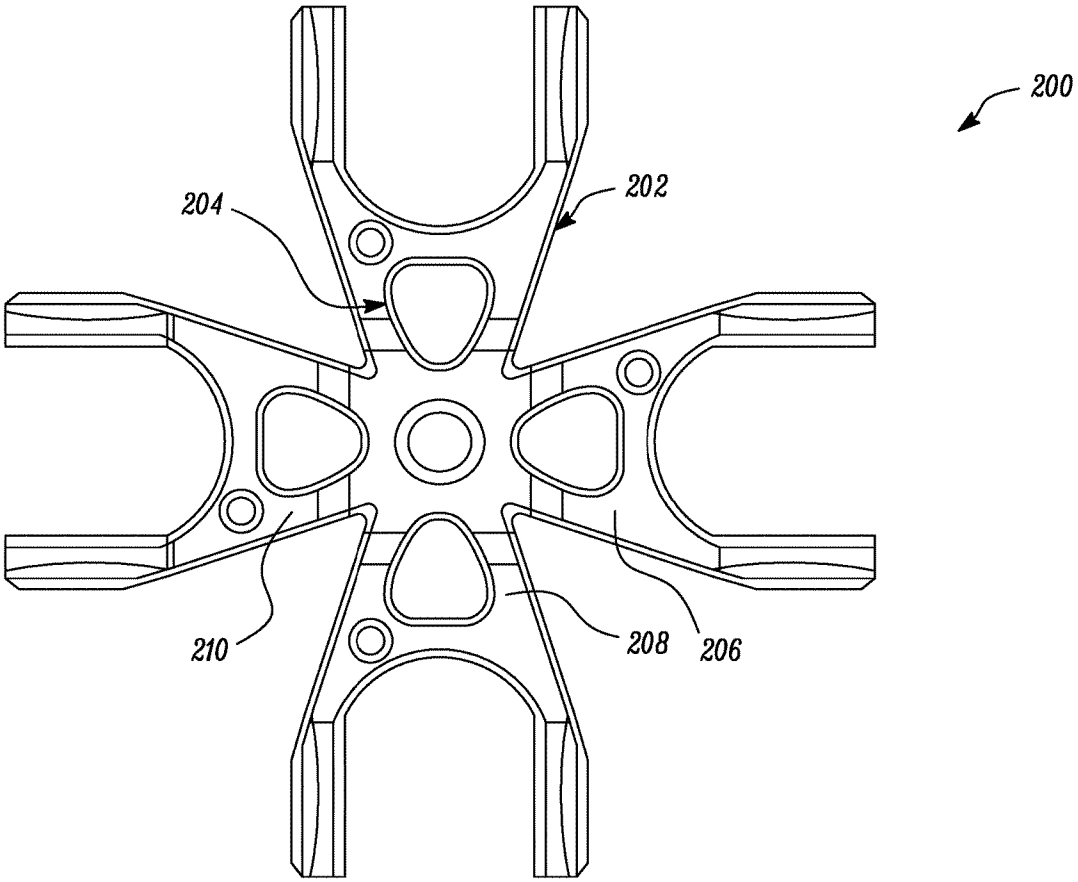
FIG. 2 is a front view of a body of an injector clamp assembly, in accordance with another embodiment of the present disclosure.

FIG. 1 illustrates a front view of an injector clamp assembly 100 having a body 102, in accordance with an embodiment of the present disclosure. As shown, the body 102 includes a first arm 104 and a second arm 106. Each arm 104, 106 has a first clamping surface 108 and a second clamping surface 110 defined on opposing sides 112, 114 of the body 102. Although the present disclosure discloses that the body 102 includes the first arm 104 and the second arm 106, in other embodiments, the body 102 of the injector clamp assembly 100 could be configured to include more than two arms. For example, the injector clamp assembly 100 could include a body 102 having three or more arms that are disposed in a star configuration. Various such configurations of the body 102 may be contemplated by persons skilled in the art depending on specific requirements of an application without deviating from the spirit of the present disclosure. For example, depending on a configuration of engine head and a location of fuel injectors therein, an injector clamp assembly 200 of the present disclosure could be configured to include a body 202 having four arms 204, 206, 208, and 210 as shown in FIG. 2. However, for the sake of convenience, the present disclosure will be explained in conjunction with the injector clamp assembly 100 having the body 102 disposed with the first and second arms 104, 106 as shown in FIGS. 1 and 3-11.

Figure 3:
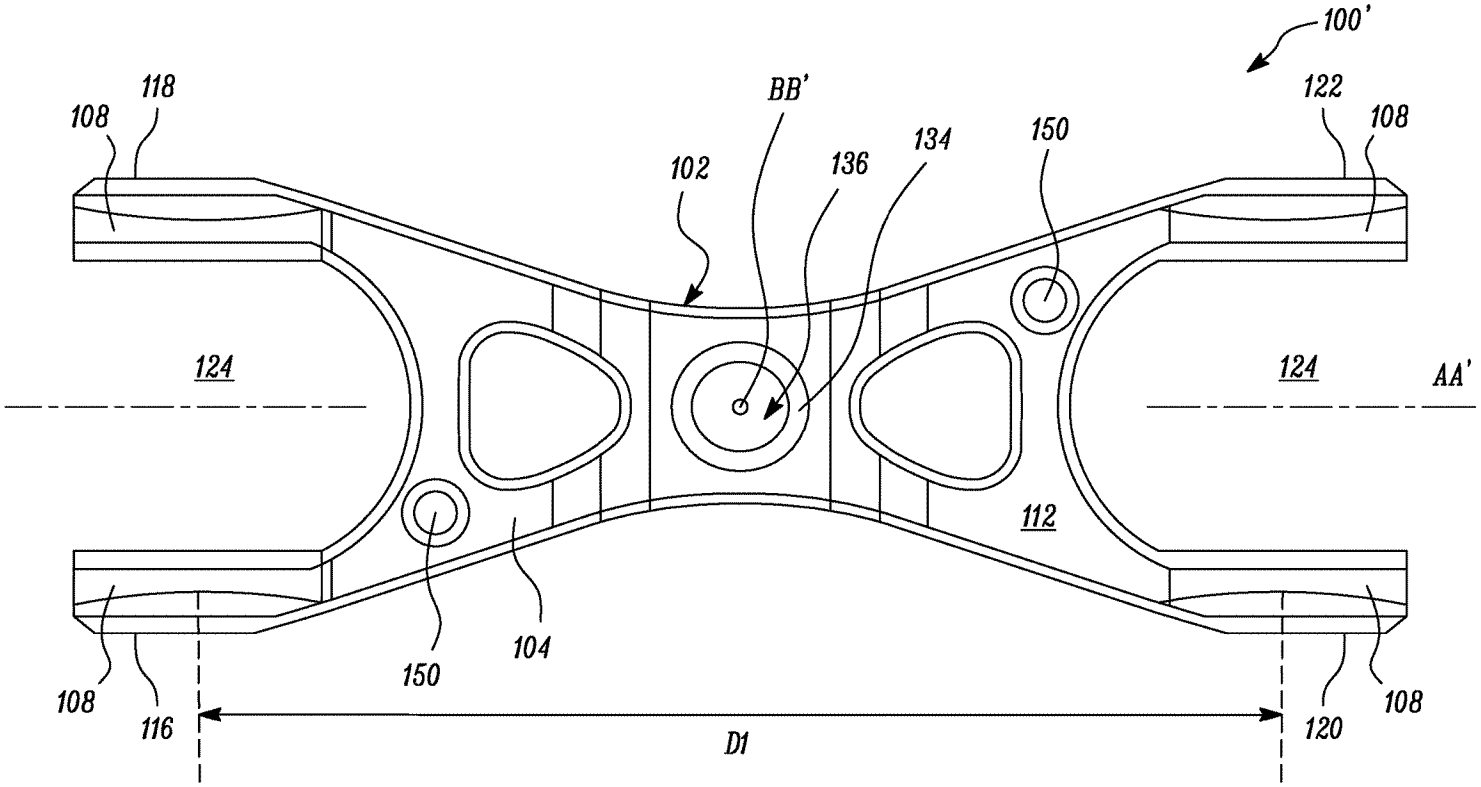
FIG. 3 is a top view of the body of the injector clamp assembly from FIG. 1.
Figure 4:
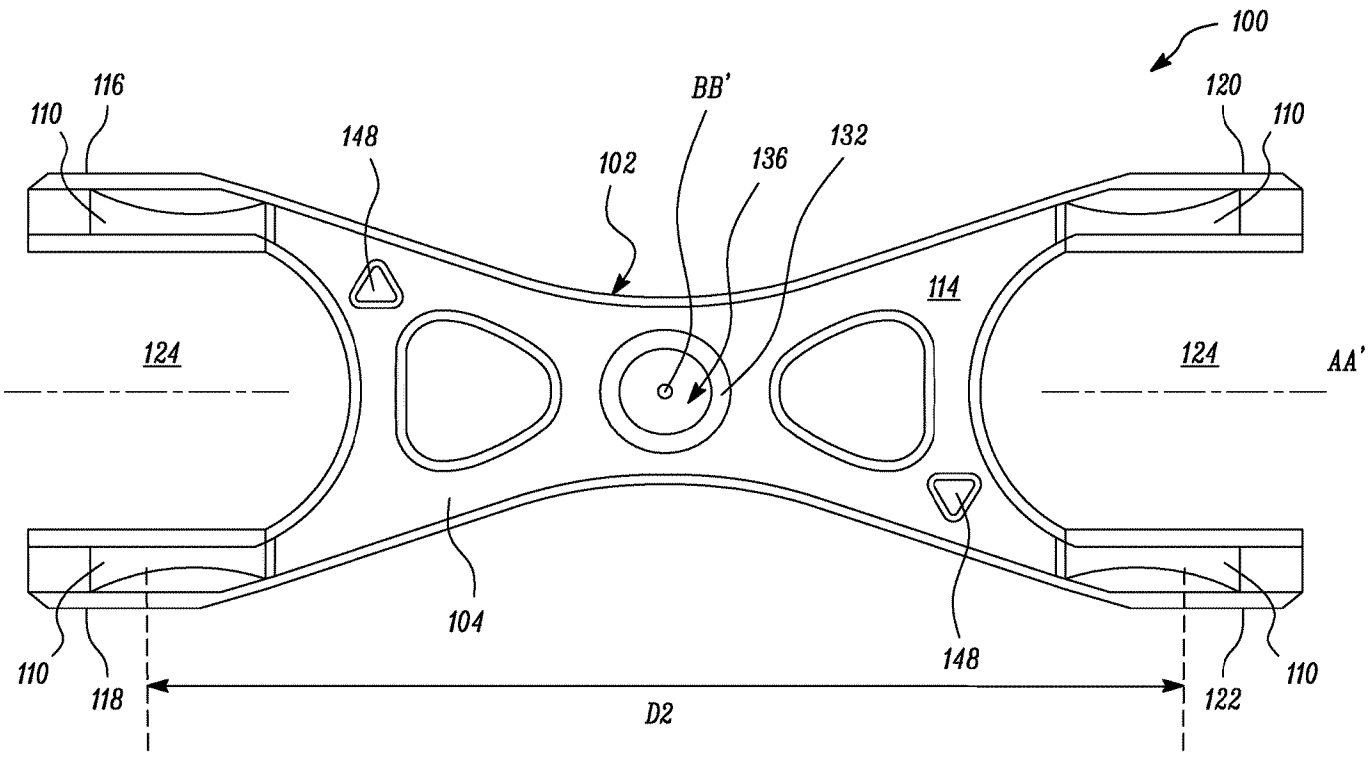
FIG. 4 is a bottom view of the body of the injector clamp assembly from FIG. 1.

In an embodiment as shown in FIGS. 1, 3, and 4, the body 102 is configured to generally extend along a longitudinal axis AA'. Moreover, each arm 104, 106 could be configured to carry a pair of appendages 116, 118, 120, 122 that are laterally spaced apart in relation to one another. As best shown in FIGS. 3 and 4, the first arm 104 is configured to carry the pair of appendages 116, 118 while the second arm 106 is configured to carry the pair of appendages 120, 122. Further, the pair of appendages 116, 118 and 120, 122 from each arm 104, 106 are configured to define a U-shaped opening 124. The U-shaped opening 124 from each pair of appendages 116, 118 and 120, 122 may facilitate a lateral insertion of a fuel injector 126 as shown in FIGS. 5-9, explanation to which will be made later in this document.

Moreover, in the illustrated embodiment of FIGS. 3 and 4. the first clamping surfaces 108 and the second clamping surfaces 110 are located on the pair of appendages 116, 118 and 120, 122 from the first arm 104 and the second arm 106, As best shown in FIG. 1, each appendage 116, 118, 120, 122 may define an upper portion 128 and a lower portion 130. Such lower portions 130 and upper portions 128 of the appendages 116, 118, 120, 122 may be configured to define thereon the first clamping surfaces 108 and second clamping surfaces 110 respectively.

Although in an embodiment herein, the first and second clamping surfaces 108, 110 are located in the upper and lower portions 128, 130 of the appendages 116, 118, 120, 122, it may be noted that in other embodiments of this disclosure, the appendages 116, 118, 120, 122 may altogether be omitted, while the first and second clamping surfaces 108, 110 may be located directly on the arms, Therefore, specific configurations of the arms and a location of the first and second clamping surfaces 108, 110 may be contemplated by persons skilled in the art depending on specific requirements of an application without deviating from the spirit of the present disclosure.

Referring to FIGS. 1, 3, and 4, a distance D1 between the first clamping surfaces 108 of the first arm 104 and the second arm 106 is different from a distance D2 between the second clamping surfaces 110 of the first arm 104 and the second arm 106. For example, as best shown in FIG. 1, the distance D1, measured between the first clamping surfaces 108 of the first arm 104 and the second arm 106, is greater than the distance D2, measured between the second clamping surfaces 110 of the first arm 104 and the second arm 106.

Figure 6:
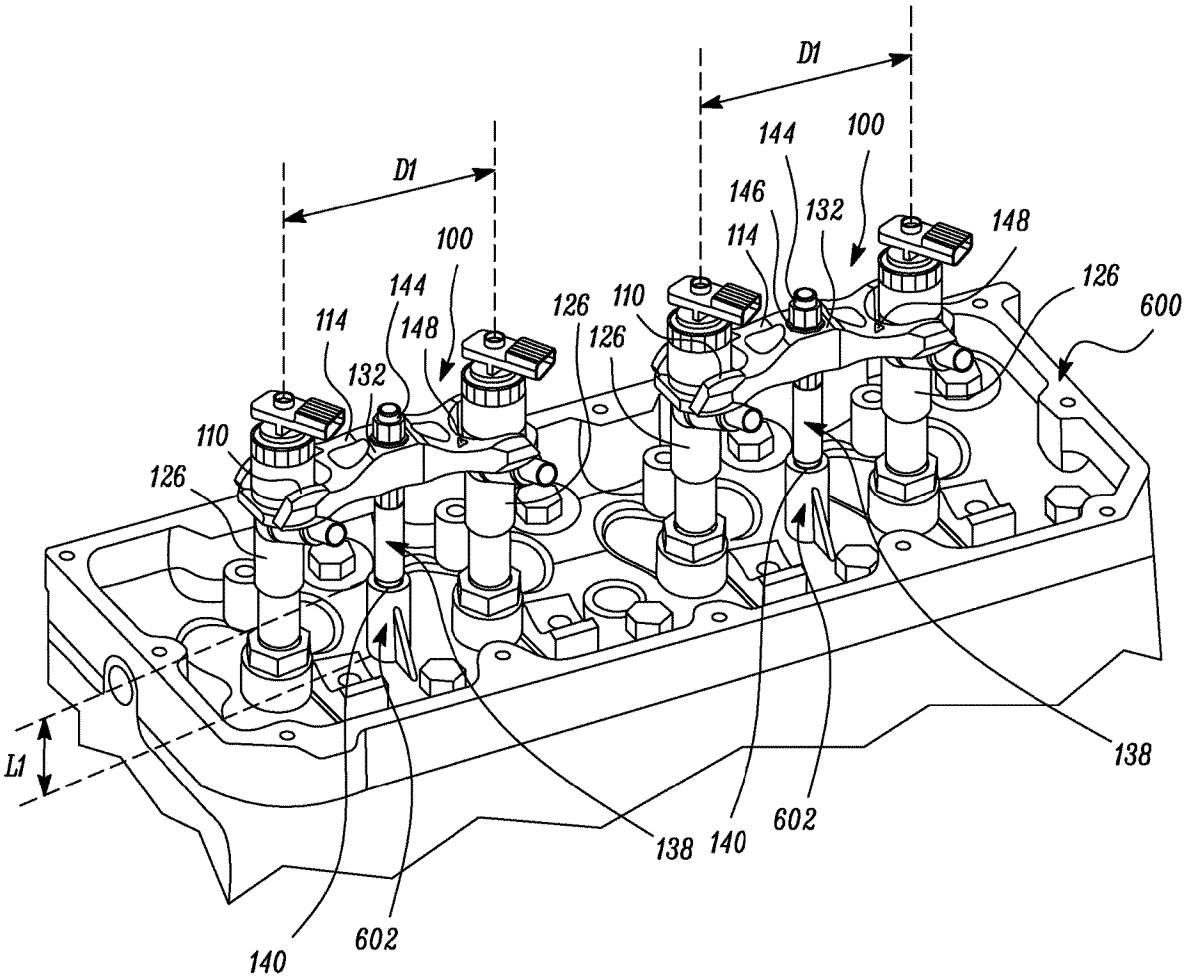
FIG. 6 is an assembled view showing the injector clamp assembly being used for mounting injectors onto an engine head with a first configuration, in accordance with an embodiment of the present disclosure.
Figure 7:
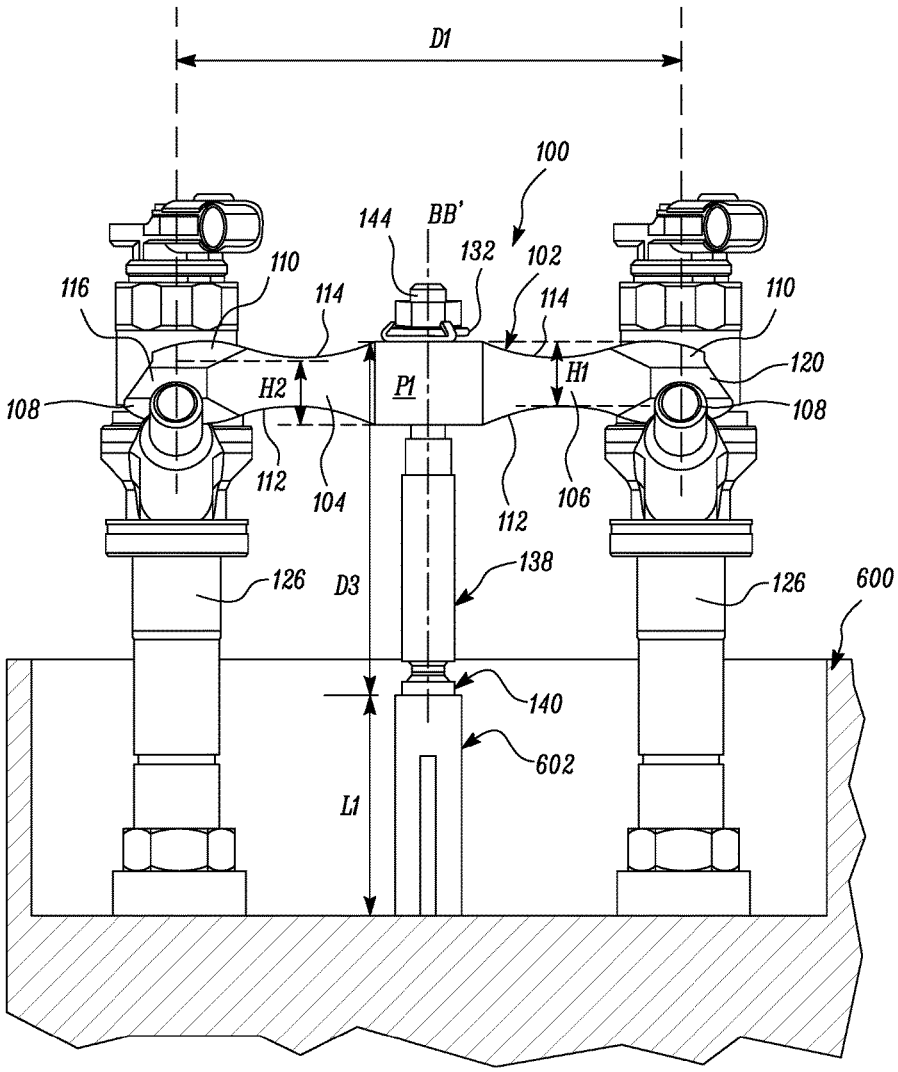
FIG. 7 is a break-away view showing a positioning of components in the injector clamp assembly for mounting the fuel injectors onto the engine head of FIG. 6, in accordance with an embodiment of the present disclosure.

With such difference between distances D1 and D2, the body 102 of the injector clamp assembly 100 is configurable, for use, in one of: a first position P1 and a second position P2. Referring to FIG. 1, the body 102 is currently positioned in the first position P1. When in the first position P1, the body 102 can facilitate the first clamping surfaces 108 from each of the first and second arms 104, 106 to abut with an injector 126 as shown in FIGS. 6 and 7.

Figure 8:
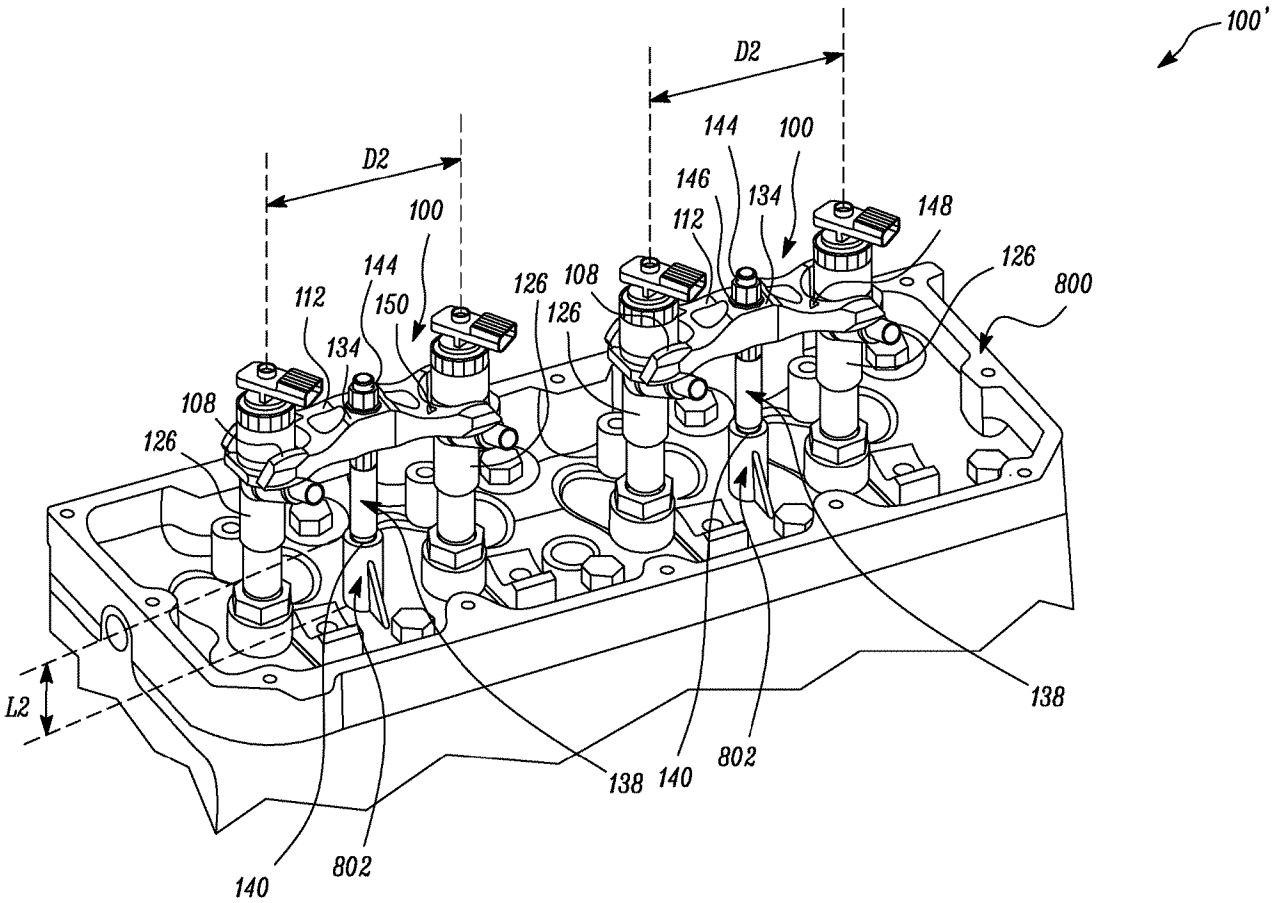
FIG. 8 is an assembled view showing the injector clamp assembly being used for mounting injectors onto an engine head with a second configuration, in accordance with an embodiment of the present disclosure.
Figure 9:
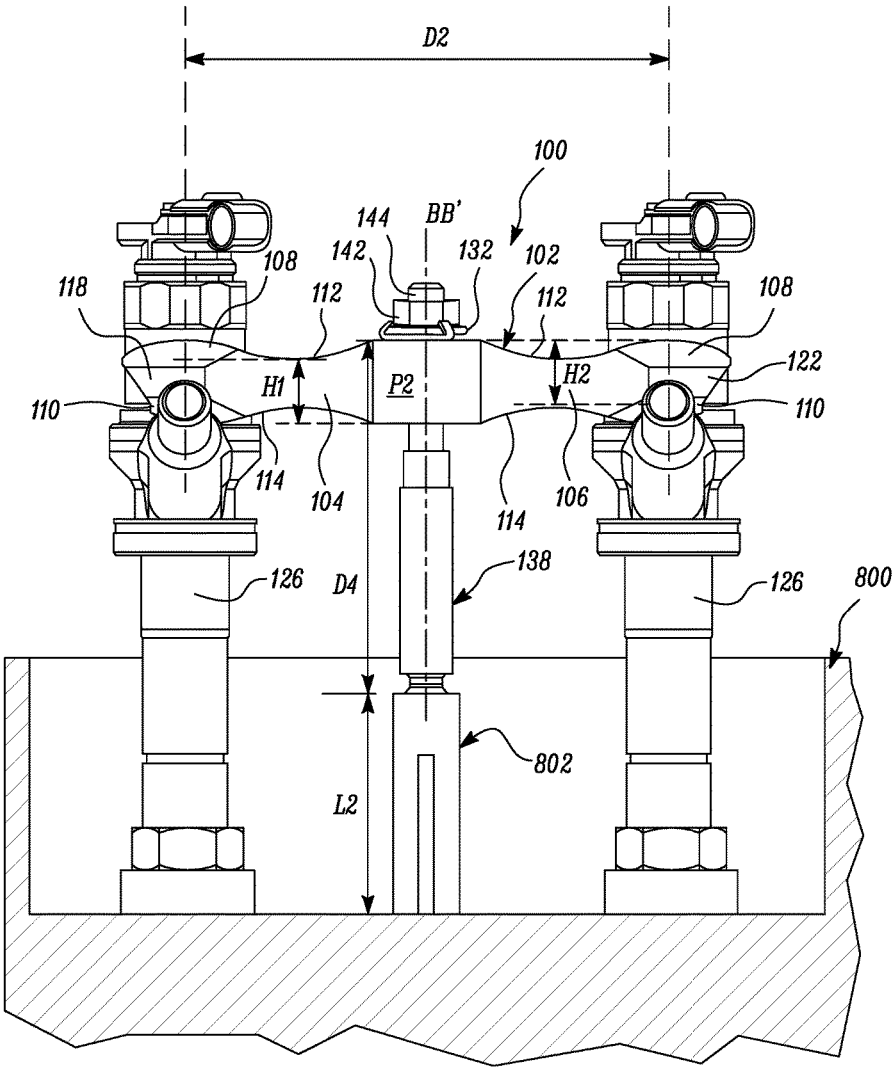
FIG. 9 is a break-away view showing a positioning of components in the injector clamp assembly for mounting the fuel injectors onto the engine head of FIG. 8, in accordance with an embodiment of the present disclosure.

The second position P2 disclosed herein can be obtained by rotating the body 102, clockwise or counter-clockwise (viewing from L.H.S or R.H.S of the body 102), about longitudinal axis AA' such that one of the opposing sides 112/114 is disposed above another of the opposing sides 112/114, in this case—upon rotation about axis AA', side 114 would be disposed above side 112. When positioned in the second position P2, the body 102 can facilitate the second clamping surfaces 110 from each of the first and second arm 104, 106 to abut with an injector 126, as shown in FIGS. 8 and 9. Therefore, in various embodiments of the present disclosure, it may be noted that depending on a specific configuration of an engine head, the body 102 can be reversibly positioned in one of—the first position P1 and the second position P2 to facilitate mounting of the fuel injectors 126 onto the given engine head.

In another embodiment of this disclosure, the body 102 further includes a first bolting area 132, and a second bolting area 134 as shown in FIGS. 1, 3, and 4. The first bolting area 132 is disposed between the second clamping surfaces 110 of the first arm 104 and the second arm 106 while the second bolting area 134 is disposed between the first clamping surfaces 108 of the first arm 104 and the second arm 106. In a further embodiment of this disclosure, a height H1 of the body 102 measured between the first bolting area 132 and the pair of first clamping surfaces 108 is different from a height 112 of the body 102 measured between the second bolting area 134 and the pair of second clamping surfaces 110. In an example as shown in FIG. 1, the height H1 of the body 102 measured between the first bolting area 132 and the pair of first clamping surfaces 108 is greater than the height H2 of the body 102 measured between the second bolting area 134 and the pair of second clamping surfaces 110.

Moreover, as shown in FIGS. 1, 3, and 4, the body 102 further defines a central orifice 136 therethrough. The central orifice 136 is co-located with and configured to extend through the first and second bolting areas 132, 134. In an embodiment as shown in FIGS. 1, 3, 4, and 5, the central orifice 136 is located about a vertical axis BB', the vertical axis BB' being disposed substantially perpendicular to the longitudinal axis AA' of the body 102. However, in other embodiments, it can be contemplated by persons skilled to the art to change an orientation of the axis BB' relative to the longitudinal axis AA' depending on specific requirements of an application.

Figure 5:
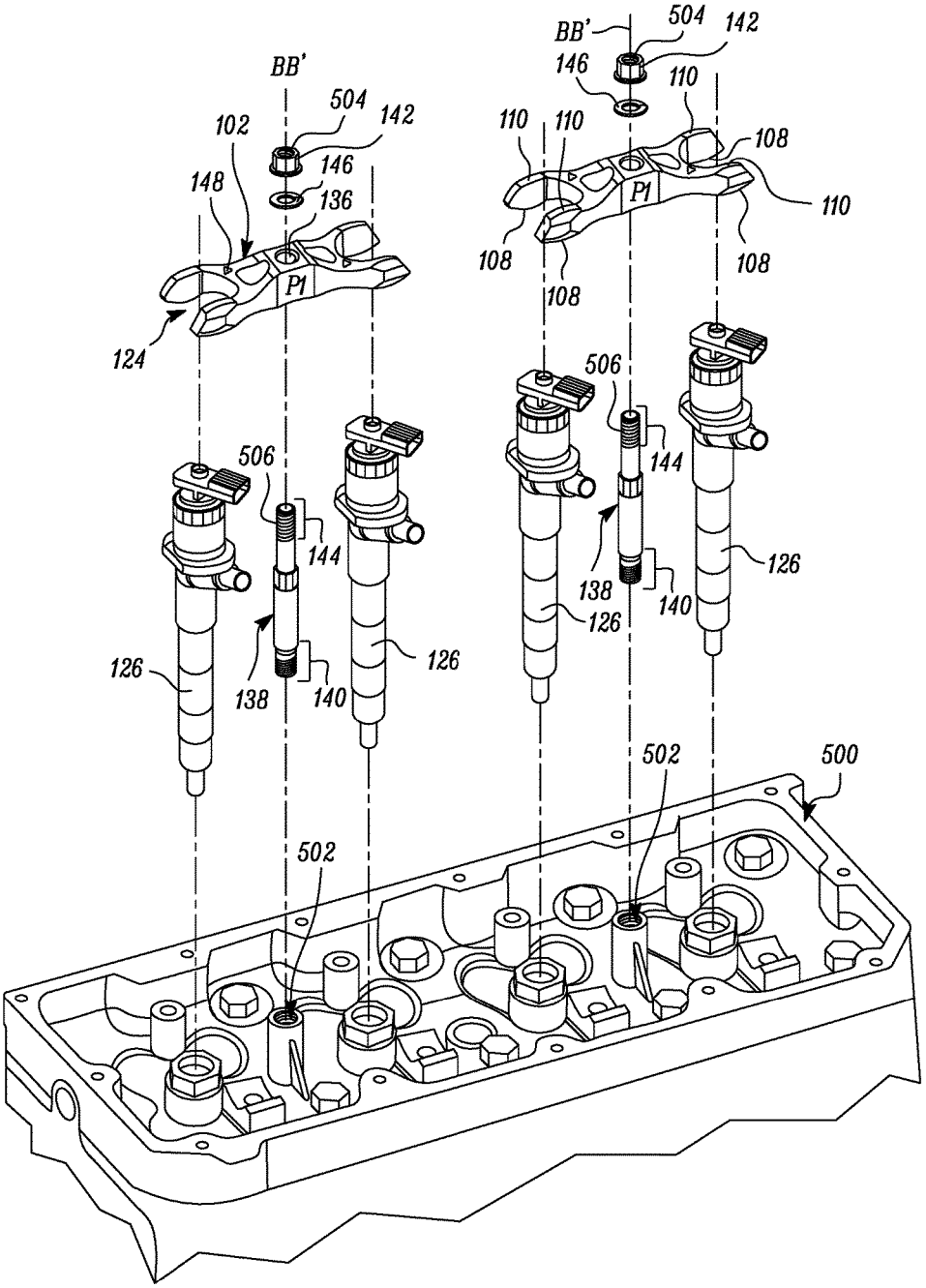
FIG. 5 is an exploded view showing a positioning of various components of the injector clamp assembly, in accordance with an embodiment of the present disclosure.

As shown in FIG. 5, the injector clamp assembly 100 further includes an elongated stud 138 that can be slidably received through the central orifice 136. The stud 138 has a first threaded portion 140 that is configured to releasably engage with a threaded receptacle 502 defined on an engine head 500. Further, the injector clamp assembly 100 also includes a fastening element 142 disposed above the body 102. The fastening element 142 is configured to threadably engage with a second threaded portion 144 of the elongated stud 138 and is configured to abut with the first bolting area 132 as shown in FIGS. 6 and 7, or with the second bolting area 134 on the body 102 as shown in FIGS. 8 and 9.

Additionally or optionally, as shown in FIG. 5, the injector clamp assembly 100 could include a retaining member 146 that is disposed between the fastening element 142 and the body 102. The retaining element could be implemented by way of, for e.g., a spring washer as shown in FIGS. 5-9, a locking pin (not shown), or other suitable structures known to one skilled in the art. As such, the retaining element is configured to maintain a position of the fastening element 142 stationary with respect to the elongated stud 138. The retaining element may thus, prevent any inadvertent disengagement of the fastening element 142 with the elongated stud 138.

Additionally or optionally, in embodiments of the present disclosure, the injector clamp assembly 100 may beneficially include at least a pair of indelible markings 148, 150 formed on the opposing sides 112, 114 of the body 102 as best shown in FIGS. 3 and 4. In an example as shown in FIGS. 1, 3, and 4, the indelible markings 148, 150 is implemented on the body 102 using protrusions formed integrally with the opposing sides 112, 114 of the body 102 for e.g., the indelible markings 148, 150 i.e., protrusions in this case may be formed from the same material as that of the body 102.

Each of the indelible markings 148, 150 is visually indicative of the body 102 being positioned in one of the first position P1 and the second position P2. For example, as shown in FIG. 1, viewing from above side 114, indelible marking 148 may be representative of the body 102 being disposed in the first position P1. It may be noted that the terms first position P1 and second position P2 of the body 102 is to be regarded as being relative to an engine head for e.g., engine head 500, 600, or 800 as shown in FIGS. 5-11 such that in the first position Pl, the body 102 can facilitate mounting of the fuel injectors 126, vis-a-vis the first clamping surfaces 108, to the engine head 600 having the first configuration as shown in FIGS. 6 and 7 while in the second position P2 of the body 102, the body 102 can facilitate mounting of the fuel injectors 126, vis-a-vis the second clamping surfaces 110, to the engine head 800 having the second configuration as shown in FIGS. 8 and 9.

Although it is disclosed herein that the indelible markings 148, 480 are implemented on opposing sides 112, 114 of the body 102 using protrusions, in alternative embodiments, the indelible markings 148, 150 can be implemented by way of, for e.g., indelible paint of two different colors; or can be characterized with for e.g., unique sets of names/part numbers/product codes of engine heads 600/800 to which the injectors 126 may be mounted. Such characterizations can be embossed or inscribed on the opposing sides 112, 114 of the body 102 to visually indicate the position of the body 102 relative to the given engine head 600/800.

It is hereby envisioned that the reversibility feature of the body 102 disclosed herein could be beneficially implemented with one or more "poka-yoke" features. For purposes of the present disclosure, "poka-yoke" features disclosed herein can be regarded as being inclusive of features such as, but not limited to, the distances D1 and D2 being different from one another, the heights H1 and H2 of the body 102 being different. Such "poka-yoke" features when incorporated on the body 102 can help prevent assembly personnel and technicians from incorrectly positioning the body 102 when installing the fuel injectors 126 to a given engine head. Additionally, the unique sets of indelible markings 148, 150 formed on opposing sides 112, 114 of the body 102 can further assist assembly personnel or technicians in quickly and easily ascertaining the correct positioning of the body 102 i.e., first position P1 or second position P2 depending on the configuration of a given engine head for e.g., engine head 600 with the first configuration as shown in FIGS. 6-7 or engine head 800 with the second configuration as shown in FIGS. 8-9.

FIGS. 6 and 7 depict the injector clamp assembly 100 being used to mount injectors 126 onto the engine head 600 having the first configuration while FIGS. 8 and 9 depict the injector clamp assembly 100 being used to mount injectors 126 onto the engine head 800 having the second configuration. It may be noted that specifications pertaining to the engine head 600 of the first configuration may be different from specifications pertaining to the engine head 800 of the second configuration. For example, a cylinder spacing i.e., a distance between adjacent cylinders (not shown) used in the engine head 600 of the first configuration could be different from a cylinder spacing used in the engine head 800 of the second configuration. Additionally or optionally, a length L1 of threaded receptacles 602 present on the engine head 600 could be different from a length L2 of threaded receptacles 802 used on the engine head 800.

With implementation of embodiments disclosed herein, it is seen that the fuel injectors 126 from FIGS. 6 and 7 are positioned in abutment with the first clamping surfaces 108 at a distance D1 while the fuel injectors 126 from FIGS. 8 and 9 are positioned in abutment with the second clamping surfaces 110 at a distance D2. In embodiments disclosed herein, the distances D1 and D2 can be selected, when forming the body 102, such that the distances D1 and D2 correspond with the cylinder spacing (not shown) of the engine head 600 or the engine head 800 to facilitate fitment of the fuel injectors 126 at distances D1 and D2 i.e., correlating to a cylinder spacing present on the respective engine heads 600 and 800.

Also, with implementation of another embodiment as shown in FIGS. 6 and 8, it is seen that the fastening element 142 abuts with the first bolting area 132 and the second bolting area 134 of the body 102 at different distances D3 and D4 with respect to the threaded receptacles 602, 802 located on the respective engine heads 600, 800. When positioned in the first and second positions P1, P2 respectively, the different heights H1 and H2 of the body 102 can cause the first and second bolting areas 132, 134 to be located at the distances D3 and D4 from the threaded receptacles 602, 802 respectively. Therefore, in embodiments of the present disclosure, it is also contemplated to select the heights H1 and H2, when forming the body 102, for implementation in the first position P1 and the second position P2 relative to the threaded receptacles 602, 802 such that the heights H1 and H2 can beneficially account for equal or unequal lengths—L1 and L2 of the threaded receptacles 602, 802 present on the engine heads 600 and 800 respectively.

Figure 10:
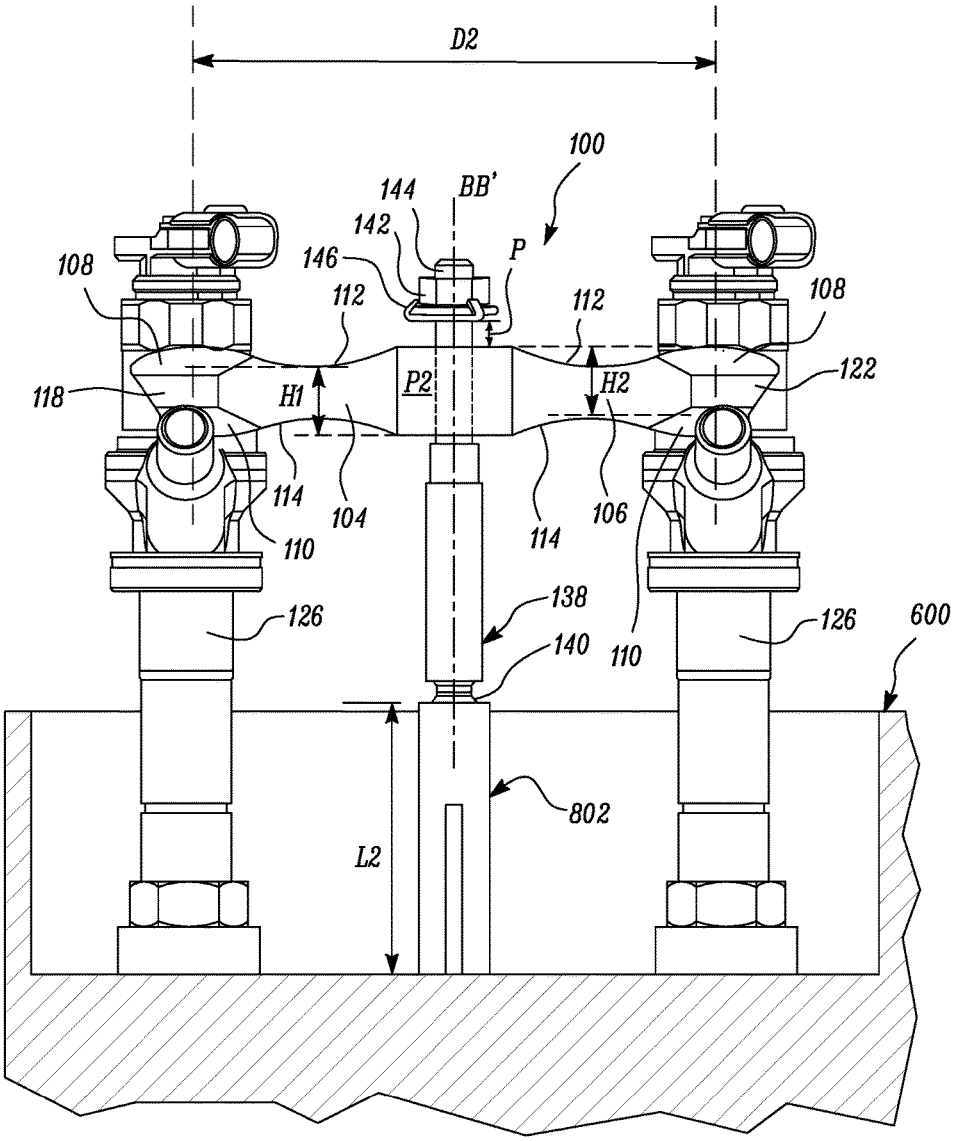
FIG. 10 is a break-away view showing the injector clamp assembly being used with poka-yoke features to prevent incorrect mounting of the injectors onto the engine head with the first configuration, in accordance with an embodiment of the present disclosure.

It is hereby contemplated that if the body 102 is incorrectly positioned in relation to a given engine head, for e.g., a second position P2 of the body 102 in place of first position P1 for the engine head 600 with first configuration as shown in FIG. 10, then an amount of engagement between threads 504 (shown in FIG. 5) of the fastening element 142 and threads 506 (shown in FIG. 5) of the second threaded portion 144 of the elongated stud 138 can cause a "play" P to exist between the fastening element 142 and the second bolting area 134. Such incorrect positioning of the body 102 may subsequently allow the body 102 to lift above the injectors 126 and/or rock about the elongated stud 138 during vibrations that are typically encountered in operation of an engine (not shown).

Figure 11:
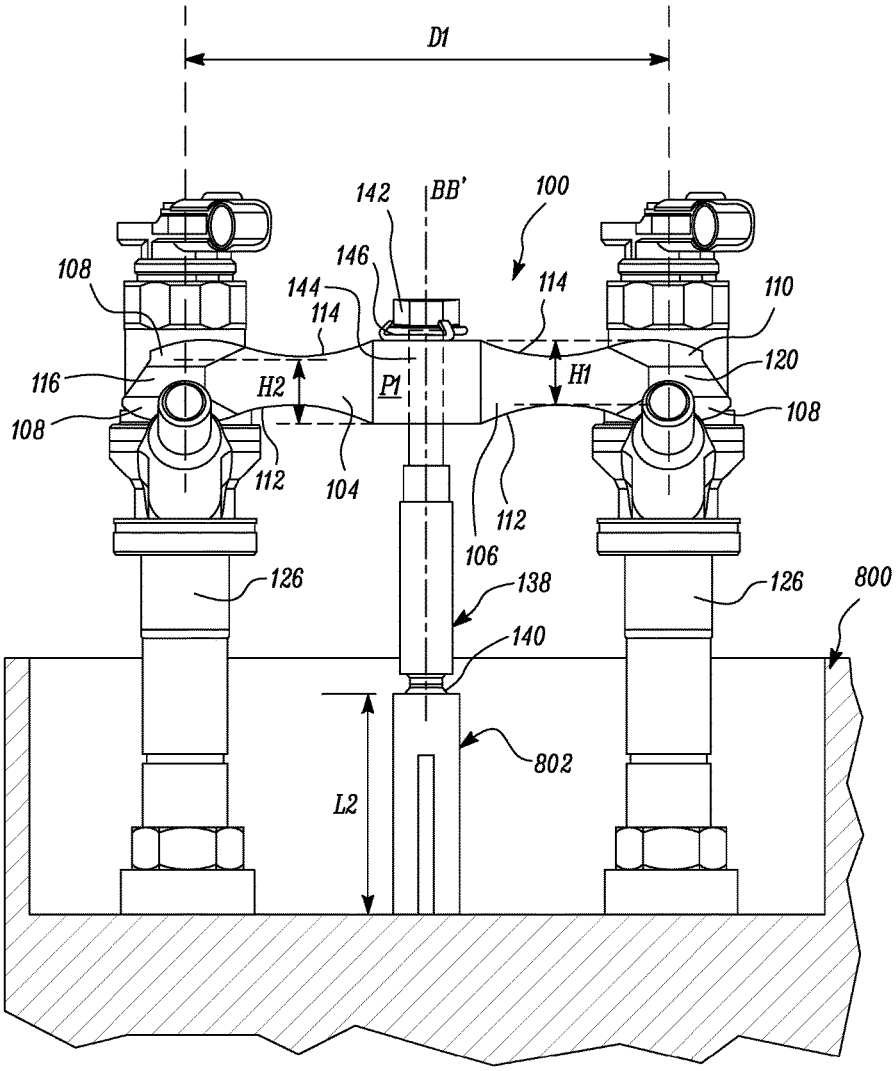
FIG. 11 is a break-away view showing the injector clamp assembly being used with poka-yoke features to prevent incorrect mounting of the injectors onto the engine head with the second configuration, in accordance with an embodiment of the present disclosure.

In another example of incorrect positioning of the body 102 as shown in FIG. 11 where a first position P1 of the body 102 is used in place of the second position P2 for the engine head 800 with second configuration, then an amount of engagement between threads 504 (as best shown in FIG. 5) of the fastening element 142 and threads 506 (as best shown in FIG. 5) of the second threaded portion 144 of the elongated stud 138 may become inadequate to firmly secure the body 102 with the elongated stud 138.

This way, the different distances D1 and D2 and/or the different heights H1 and H2 disclosed herein can beneficially account for different cylinder spacing and/or the equal or unequal lengths L1, L2 of the threaded receptacles 602, 802 on the pair of respective engine heads 600, 800 and therefore, implement the "poka-yoke" feature in components of the injector clamp assembly 100. Thus, the "poka-yoke" features can help prevent assembly personnel or technicians from inadvertently positioning the body 102 into an incorrect position i.e., first position P1 in place of second position P2 and vice-versa when installing fuel injectors 126 onto an engine head 600/800 with a given configuration.

It should be noted that in various embodiments disclosed herein, dimensions of the injector clamp assembly 100 can be enlarged, diminished, or modified relative to one another to suit specific requirements of an application. Such requirements may include for e.g., increased stiffness to provide added down-force when clamping the injectors to the engine head 600/800, adherence of the injector clamp assembly 100 to limitations of space-constraint, but is not limited thereto. In another example, a length of the elongated stud 138 may be made longer or shorter depending on the length L1/L2 of the threaded receptacles 602/802. Persons skilled in the art will acknowledge that various design modifications may be contemplated and implemented on the injector clamp assembly 100 to meet various requirements of an application without deviating from the spirit of the present disclosure.

Various embodiments disclosed herein are to be taken in the illustrative and explanatory sense, and should in no way be construed as limiting of the present disclosure. All joinder references (e.g., attached, affixed, associated, coupled, engaged, connected, locked, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

Embodiments of the present disclosure have applicability for use and implementation in manufacturing injector 126 clamp assemblies that can be used to mount fuel injectors onto different configurations of engine heads.

With implementation of the present disclosure, manufacturers of engine components can beneficially produce a single injector clamp assembly for a pair of engine heads, each of the engine heads having a different configuration from the other. Therefore, with use of embodiments disclosed herein, manufacturers can reduce time and effort required to produce unique injector clamps for different engine head configurations. Moreover, manufacturers could use a single production line to produce the injector clamp assembly 100 disclosed herein for mounting injectors 126 onto one of two different engine head configurations 600/800. Therefore, manufacturers of engine components can also significantly offset costs for e.g., tooling and/or equipment costs, labor costs, and the like typically associated with producing unique injector clamps for different engine head configurations.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. An injector clamp for clamping at least two injectors to an engine head, the injector clamp comprising:

a body having at least a first arm and a second arm, each arm having a first clamping surface and a second clamping surface on opposing sides of the body, wherein a distance between the first clamping surfaces of the first arm and the second arm is different from a distance between the second clamping surfaces of the first arm and the second arm, wherein the body is configurable, for use, in one of:

a first position, wherein the first clamping surfaces from each of the first and second arms abut an injector; and a second position, wherein the second clamping surfaces from each of the first and second arms abut an injector.

2. The injector clamp assembly of claim 1, wherein the body further comprises:

a first bolting area disposed between the second clamping surfaces of the first arm and the second arm; and a second bolting area disposed between the first clamping surfaces of the first arm and the second arm.

3. The injector clamp assembly of claim 2, wherein a height of the body measured between the first bolting area and the pair of second clamping surfaces is different from a height of the body measured between the second bolting area and the pair of first clamping surfaces.

4. The injector clamp assembly of claim 3, wherein the body defines a central orifice therein, the central orifice being co-located with and configured to extend through the first and second bolting areas.

5. The injector clamp assembly of claim 4 further comprising:

an elongated stud slidably received through the central orifice, the stud having a first threaded portion and a second threaded portion, wherein the first threaded portion is configured to releasably engage with a threaded receptacle defined on the engine head; and a fastening element disposed above the body, the fastening element threadably engaged with the second threaded portion of the elongated stud and configured to abut with at least one of: the first bolting area and the second bolting area on the body.

6. The injector clamp assembly of claim 5 further comprising a retaining member disposed between the fastening element and the body, the retaining member configured to maintain a position of the fastening element stationary with respect to the body.

7. The injector clamp assembly of claim 1 further comprising at least a pair of indelible markings formed on the opposing sides of the body.

8. The injector clamp assembly of claim 7, wherein each of the indelible markings is visually indicative of one of:

the first position of the body, wherein the body is configured to facilitate mounting of fuel injectors to an engine head having a first configuration; and the second position of the body, wherein the body is configured to facilitate mounting of fuel injectors to an engine head having a second configuration.

9. An injector clamp for clamping at least two injectors to an engine head, the injector clamp comprising:

a body having at least a first arm and a second arm, each arm having a first clamping surface and a second clamping surface on opposing sides of the body;

a first bolting area disposed between the second clamping surfaces of the first arm and the second arm; and a second bolting area disposed between the first clamping surfaces of the first arm and the second arm, wherein a height of the body measured between the first bolting area and the pair of second clamping surfaces is different from a height of the body measured between the second bolting area and the pair of first clamping surfaces.

10. The injector clamp assembly of claim 9, wherein a distance between the first clamping surfaces of the first arm and the second arm is different from a distance between the second clamping surfaces of the first arm and the second arm.

11. The injector clamp assembly of claim 9, wherein the body is configurable, for use, in one of:

a first position, wherein the first clamping surfaces from each of the first and second arms abut an injector; and a second position, wherein the second clamping surfaces from each of the first and second arms abut an injector.

12. The injector clamp assembly of claim 9, wherein the body defines a central orifice therein, the central orifice being co-located with and configured to extend through the first and second bolting areas.

13. The injector clamp assembly of claim 12 further comprising:

an elongated stud slidably received through the central orifice, the stud having a first threaded portion and a second threaded portion, wherein the first threaded portion is configured to releasably engage with a threaded receptacle defined on the engine head; and a fastening element disposed above the body, the fastening element threadably engaged with the second threaded portion of the elongated stud and configured to abut with at least one of: the first bolting area and the second bolting area on the body.

14. The injector clamp assembly of claim 13 further comprising a retaining member disposed between the fastening element and the body, the retaining member configured to maintain a position of the fastening element stationary with respect to the body.

15. The injector clamp assembly of claim 9 further comprising at least a pair of indelible markings formed on the opposing sides of the body.

16. The injector clamp assembly of claim 15, wherein each of the indelible markings is visually indicative of one of:

the first position of the body, wherein the body is configured to facilitate mounting of fuel injectors to an engine head having a first configuration; and the second position of the body, wherein the body is configured to facilitate mounting of fuel injectors to an engine head having a second configuration.

17. A reversible injector clamp assembly for mounting at least a pair of injectors on one of two different configurations of engine heads, the reversible injector clamp assembly comprising:

a body extending along a longitudinal axis and having a pair of arms, wherein each arm carries a pair of appendages laterally spaced apart in relation to one another, each of the appendages having a lower portion and an upper portion respectively, wherein a pair of first clamping surfaces defined in the lower portions of the appendages from the pair of arms is spaced apart from one another at a first distance, and wherein a pair of second clamping surfaces defined in the upper portions of the appendages from the pair of arms is spaced apart from one another at a second distance lesser than the first distance.

18. The reversible twin injector clamp assembly of claim 17, wherein the body defines a central orifice extending therethrough and disposed along a vertical axis, the vertical axis being disposed substantially perpendicular to the longitudinal axis.

19. The reversible twin injector clamp assembly of claim 18 further comprising:

an elongated stud slidably received through the central orifice, the stud having a first threaded portion and a second threaded portion, wherein the first threaded portion is configured to releasably engage with a threaded receptacle defined on the engine head; and a fastening element threadably engaged with the second threaded portion of the elongated stud and configured to abut with the body.

20. The reversible twin injector clamp assembly of claim 17 further comprising at least a pair of indelible markings formed on the body, wherein each of the indelible markings is visually indicative of one of:

a first position of the body, wherein the first clamping surfaces from each of the first and second arms abut an injector; and a second position of the body, wherein the second clamping surfaces from each of the first and second arms abut an injector.

* * * * *